US011559125B2

(12) United States Patent
Taylor

(10) Patent No.: US 11,559,125 B2
(45) Date of Patent: Jan. 24, 2023

(54) HANDS FREE BLOW DRYER

(71) Applicant: Richelle Taylor, Blaine, MN (US)

(72) Inventor: Richelle Taylor, Blaine, MN (US)

( * ) Notice: Subject to any disclaimer, the term of this patent is extended or adjusted under 35 U.S.C. 154(b) by 55 days.

(21) Appl. No.: 17/191,675

(22) Filed: Mar. 3, 2021

(65) Prior Publication Data

US 2021/0274906 A1 Sep. 9, 2021

Related U.S. Application Data

(60) Provisional application No. 62/985,299, filed on Mar. 4, 2020.

(51) Int. Cl.
*A45D 20/14* (2006.01)

(52) U.S. Cl.
CPC ..... *A45D 20/14* (2013.01)

(58) Field of Classification Search
CPC ..... A45D 20/00; A45D 20/14
USPC ..... 34/95–100; 392/380–384
See application file for complete search history.

(56) References Cited

U.S. PATENT DOCUMENTS 3,131,281 A * 4/1964 Jepson ..... A45D 20/18 219/486
3,397,463 A * 8/1968 Laing ..... A45D 20/10 415/203
5,074,006 A * 12/1991 Eremita ..... A47L 5/24 15/352
5,526,578 A * 6/1996 Iyer ..... A45D 20/50 239/443
7,184,655 B2 * 2/2007 Dehli ..... A47C 16/02 34/90
7,356,942 B2 * 4/2008 Lin ..... F23D 14/38 431/344
9,756,922 B1 * 9/2017 Duthe ..... A45D 20/12
9,930,950 B1 * 4/2018 Cage ..... A45D 20/12
9,986,810 B2 * 6/2018 Bobillier ..... A45D 20/12
11,013,376 B2 * 5/2021 Yoo ..... A45D 20/12
11,253,039 B1 * 2/2022 Lei ..... A45D 20/12
2021/0274906 A1 * 9/2021 Taylor ..... A45D 20/14
2022/0142327 A1 * 5/2022 Lei ..... A45D 20/12

* cited by examiner

*Primary Examiner* — Stephen M Gravini
(74) *Attorney, Agent, or Firm* — José W. Jimenez; Jimenez Law Firm

(57) ABSTRACT

A hands-free hair dryer assembly that has a concave housing assembly with an open top portion, at least one side surface, and a bottom portion having a bottom exterior surface. At least one air inlet is disposed through the bottom surface or the at least one side surface. At least one electrical fan assembly heats and blows air drawn through the at least one air inlet. An airflow distribution plenum directs heated air out the open top portion. A plurality of removable, protruding duct members disposed within the concave housing assembly broadens the airflow distribution and changes the speed of the airflow. The housing portions may be divided into two parts so that the hands-free hair dryer can be at least partly extended or retracted to change the dimensions of the open top portion.

9 Claims, 5 Drawing Sheets

HANDS FREE BLOW DRYER

CLAIM OF PRIORITY

This application claims the benefit of and priority to U.S. provisional application No. 62/985,299, filed on Mar. 4, 2020, titled HANDS FREE BLOWER DRYER, the contents of which is incorporated by reference in its entirety.

FIELD OF THE INVENTION

The inventive concept relates generally to a hands-free blower dryer.

BACKGROUND

Currently, there are a number of solutions for drying hair. One of these solutions attempts to utilize a blow dryer, but this solution fails to meet the needs of the market because blow driers require using at least one hand. Another solution attempts to let hair air dry, but this solution is similarly unable to meet the needs of the market because waiting for hair to dry can be inconvenient. Still another solution seeks to have another person dry hair, but this solution also fails to meet market needs because another person may not be available. Therefore, there currently exists a need in the market for an apparatus that simplifies the hair drying process for a user, especially with long hair, and may need to dry it quickly as well.

SUMMARY OF THE INVENTION

The inventive concept is a hands-free hair dryer assembly that is operable in an inverted mode and can be located on various surfaces of differing heights. In one embodiment, the hands-free hair dryer assembly has a concave housing assembly with an open top portion, at least one side surface, and a bottom portion having a bottom exterior surface, a plurality of hole members disposed through the bottom exterior surface. The concave housing assembly is divided into a first housing portion and a second housing portion, the first housing portion being wider than the second housing portion, the second housing portion designed to nest at least partly inside the first housing portion and to change the dimensions of the open top portion as the second housing portion is extended from or retracted into the first housing portion. At least one air inlet is disposed through at least one or more of the bottom surface and the at least one side surface. At least one electrical fan assembly is designed to heat and blow air drawn through the at least one air inlet. An airflow distribution plenum is disposed within the concave housing assembly and designed to direct heated air out the open top portion. A plurality of protruding duct members is disposed within the concave housing assembly designed to broaden the airflow distribution and change the speed of the airflow. A control assembly is electrically coupled to a power supply designed to allow the user to control at least one or more of power, heat level, airflow speed, height, tilt, and extension-and retraction of the second housing member disposed at least partly within the first housing member.

In one embodiment of the hands-free hair dryer assembly, at least one support structure is designed to at least partly separate the bottom surface from a support surface on which the hands-free hair dryer assembly is located.

In one embodiment of the hands-free hair dryer assembly, there are at least two support structures telescopically extendable so as to change at least one or more of the height and angle of the concave housing assembly.

In one embodiment of the hands-free hair dryer assembly, at least one removable additional row of protruding duct members can be disposed within the concave housing assembly when the concave housing assembly is at least partly extended.

In one embodiment of the hands-free hair dryer assembly, an open polymer rim member circumscribes an upper rim portion of the concave housing assembly designed to further channel airflow emanating up from the protruding duct members and open top portion.

In one embodiment of the hands-free hair dryer assembly, a rechargeable battery member is disposed within the concave housing assembly, the rechargeable battery member designed to store and provide power.

Another embodiment of the hands-free hair dryer assembly has a substantially cuboid concave housing assembly with an open top portion, at least one side surface, and a bottom portion having a bottom exterior surface, a plurality of hole members disposed through the bottom exterior surface. The concave housing assembly is divided into a first housing portion and a second housing portion, the first housing portion being wider than the second housing portion, the second housing portion designed to nest at least partly inside the first housing portion and to change the dimensions of the open top portion as the second housing portion is extended from or retracted into the first housing portion. At least one air inlet is disposed through the right side surface and at least one air inlet is disposed through the left side surface of the concave housing assembly. At least one electrical fan assembly is designed to heat and blow air drawn through the at least one air inlet. An airflow distribution plenum is disposed within the concave housing assembly and designed to direct heated air out the open top portion. A plurality of sixteen to twenty-four protruding duct members is disposed within the concave housing assembly designed to broaden the airflow distribution and change the speed of the airflow. At least two support structures are telescopically extendable so as to change at least one or more of the height and angle of the concave housing assembly. A control assembly is electrically coupled to a power supply designed to allow the user to control power, heat level, airflow speed, height, tilt, and extension-and retraction of the second housing member disposed at least partly within the first housing member.

In this embodiment of the hands-free hair dryer assembly, at least one removable additional row of protruding duct members can be disposed within the concave housing assembly when the concave housing assembly is at least partly extended.

In this embodiment of the hands-free hair dryer assembly, an open polymer rim member circumscribes an upper rim portion of the concave housing assembly designed to further channel airflow emanating up from the protruding duct members and open top portion.

In this embodiment of the hands-free hair dryer assembly, a rechargeable battery member is disposed within the concave housing assembly, the rechargeable battery member designed to store and provide power.

It would be advantageous to have a hands-free hair dryer assembly that is hands-free, invertible, and movable to surfaces of differing heights to accommodate a user's needs. Furthermore, it would be advantageous to have a hands-free hair dryer assembly that is adjustable for differing hair lengths and types. Other advantages of the inventive concept include: increased hair volume, reduced frizz and hair dryness from the hair blowing around instead of being held in place while drying, and reduced or eliminated strain on the arms, shoulders and back while attempting to dry hair with a hand-held traditional dryer/blower.

One of ordinary skill in the art would recognize that the hands-free hair dryer assembly could be powered from external sources such as an outlet or internal sources such as a battery or rechargeable battery.

One of ordinary skill in the art would recognize that the support surface on the bottom exterior surface of the hands-free hair dryer assembly could be extendable or removable. One of ordinary skill in the art would recognize that on-a-surface could include a surface of generally horizontal, slanted, vertical, or inverted orientation.

The inventive concept advantageously fills the aforementioned deficiencies by providing a hands-free blow dryer, which provides a way for users to dry their hair while the head is inverted or partly inverted. The inventive concept fulfills the need for an inverted hair dryer.

Among other things, it is an advantage of the inventive concept to provide a hands-free blow dryer that does not suffer from problems or deficiencies associated with prior solutions.

The inventive concept now will be described more fully hereinafter with reference to the accompanying drawings, which are intended to be read in conjunction with both this summary, the detailed description, and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete, and will fully convey the full scope of the inventive concept to those skilled in the art.

DETAILED DESCRIPTION OF THE INVENTION

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Figure 1:
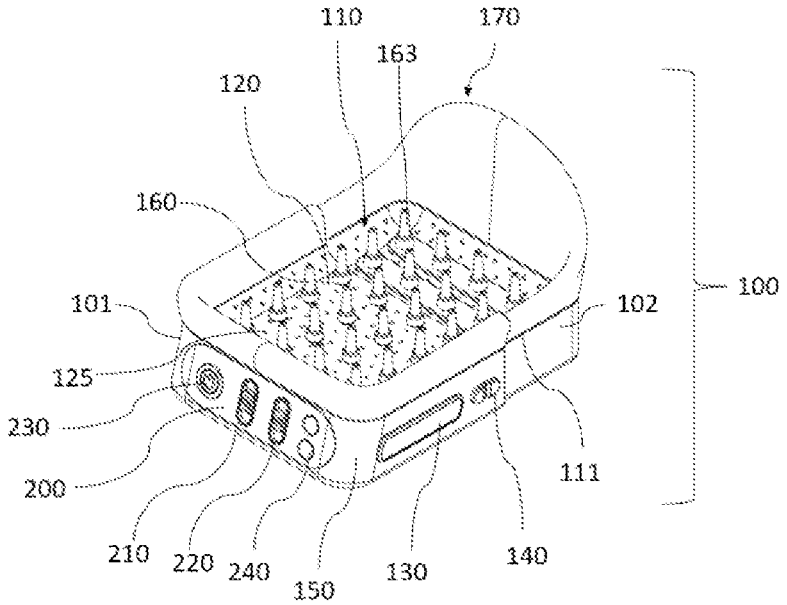
FIG. 1 illustrates the perspective view of the hands-free hair dryer assembly.

Referring to the Figures, FIG. 1 illustrates a hands-free hair dryer assembly 10 for a user which includes a concave housing assembly 100 having an open top portion 110 and at least one sidewall surface 150. At least one air inlet 130 is disposed through the at least one sidewall surface 150, which channels air through to the open top portion 110 that is treated (heated or warmed) before flowing through the top portion 110, the top portion 110 having a plurality of hole members 125 disposed through a bottom exterior surface 120. A plurality of removable, protruding duct or channel members 160 disposed within the concave housing assembly 100 are designed for broadening the airflow distribution and changing the speed of the airflow through the concave housing assembly 100. The concave housing assembly 100 is divided into a first housing portion 101 that is wider than a second housing portion 102, the second housing portion 102 is designed to nest at least partly inside the first housing portion 101 to change the dimensions of the open top portion 110 as the second housing portion 102 is extended from or retracted into the first housing portion 101.

In this example embodiment, a tilt control button 140 is disposed on the at least one sidewall surface 150. An open polymer rim member 170 circumscribes an upper rim portion of the concave housing assembly 111 designed to further channel airflow emanating up from the protruding duct members 160 and open top portion 110. At least one removable additional row of protruding duct members 163 can be disposed within the concave housing assembly 100 when the concave housing assembly 100 is at least partly extended.

Figure 2:
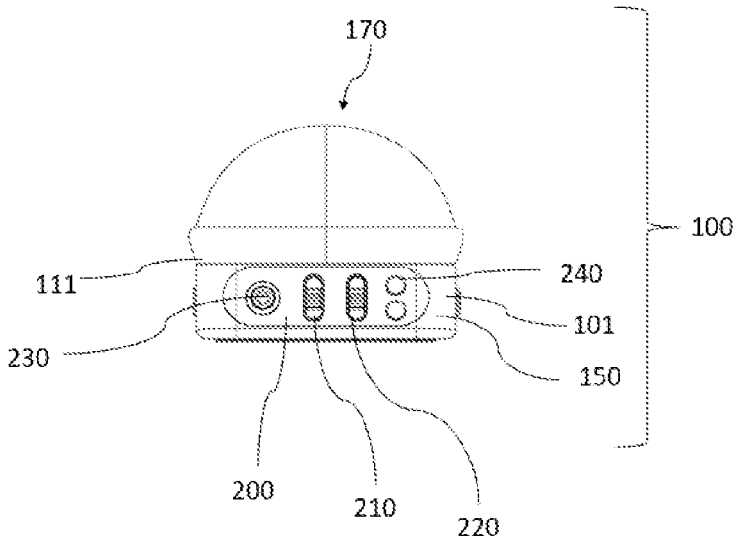
FIG. 2 illustrates the front of the hands-free hair dryer assembly.

FIGS. 1 and 2 illustrate a control panel assembly 200 designed to allow the user to control the heat level via a heat switch 210 and the airflow speed via an air flow speed switch 220. A power switch 230 is on the control panel 200 along with a size control switch 240 to extend or contract the second housing portion 102 from the first housing portion 101 thereby making adjustments to accommodate different hair lengths of the user.

Figure 3:
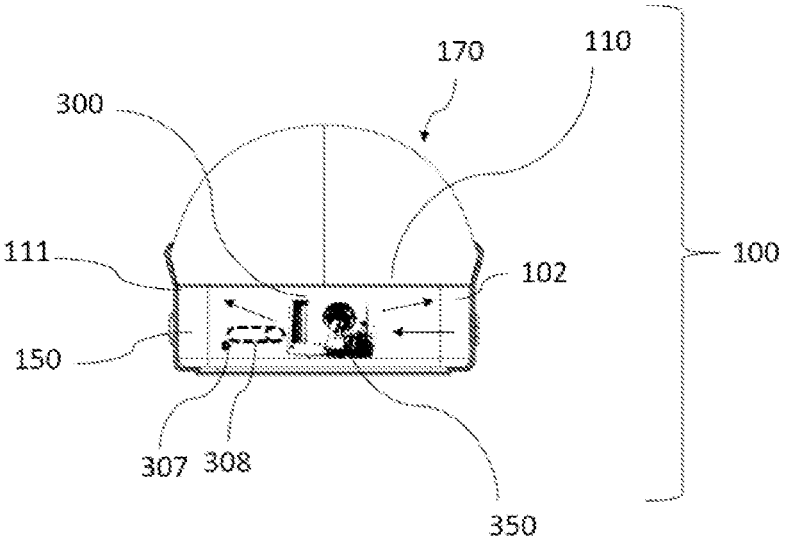
FIG. 3 illustrates the back of the hands-free hair dryer assembly.

FIG. 3 illustrates an electrical fan assembly 300 designed to heat and blow air drawn through the at least one air inlet 130. An airflow distribution plenum 350 is disposed within the concave housing assembly 100 and is designed to direct heated or non-heated air out the open top portion 110. The control assembly 200 is electrically coupled to a power supply from a power supply input 307 designed to allow the user to control at least one or more of power, heat level, airflow speed, height, tilt, and extension-and retraction of the second housing member disposed at least partly within the first housing member. A rechargeable battery member 308 may be disposed within the concave housing assembly 100, the rechargeable battery member 308 designed to store and provide power.

Figure 4:
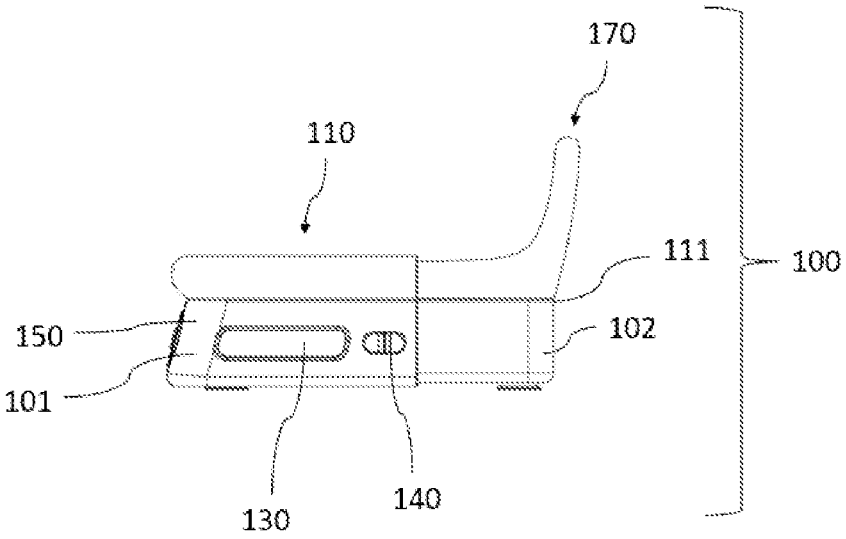
FIG. 4 illustrates the right side of the hands-free hair dryer assembly.

FIG. 4 illustrates a right side view of the concave housing assembly 100.

Figure 5:
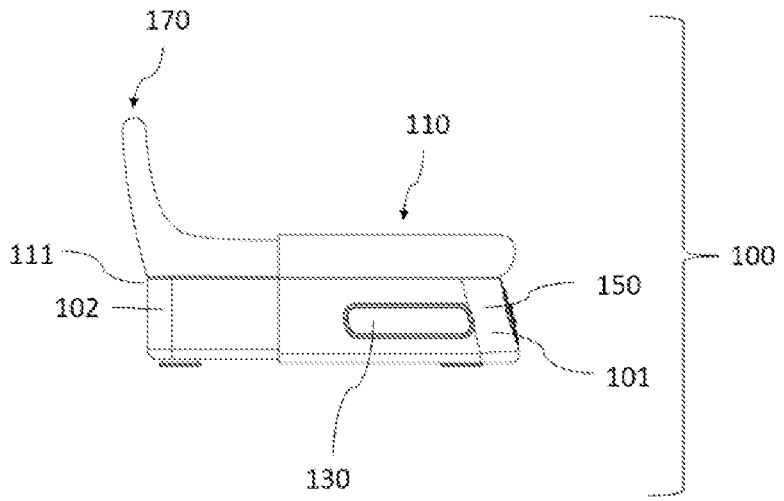
FIG. 5 illustrates the left side of the hands-free hair dryer assembly.

FIG. 5 illustrates a left side view of the concave housing assembly 100.

Figure 6:
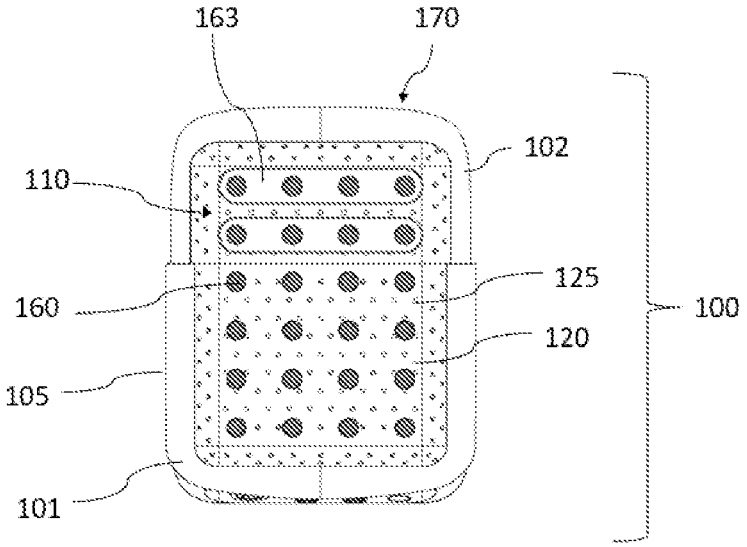
FIG. 6 illustrates the top of the hands-free hair dryer assembly.

FIG. 6 illustrates a top view of the concave housing assembly 100.

Figure 7:
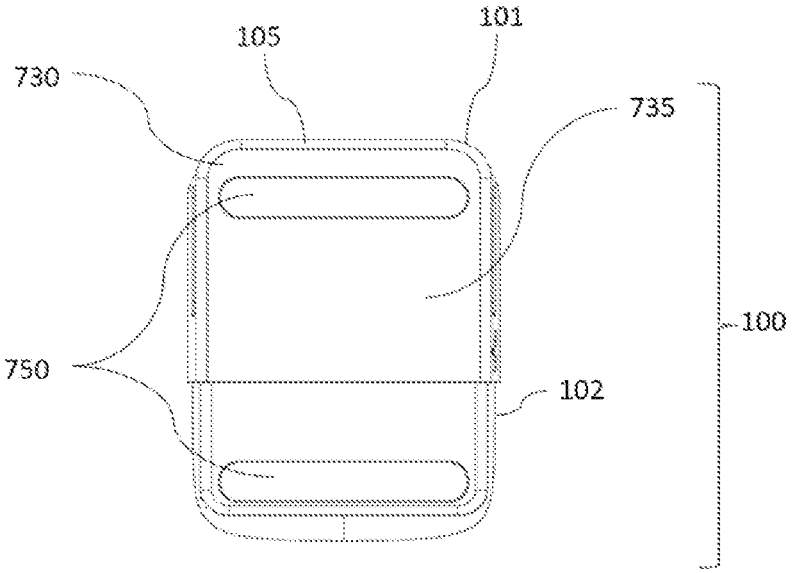
FIG. 7 illustrates the bottom of the hands-free hair dryer assembly.

FIG. 7 illustrates a bottom view of the concave housing assembly 730 having a bottom exterior surface 735. A support structure 750 is designed to at least partly separate the bottom exterior surface 735 from a support surface on which the hands-free hair dryer assembly 100 is located.

Figure 8A:
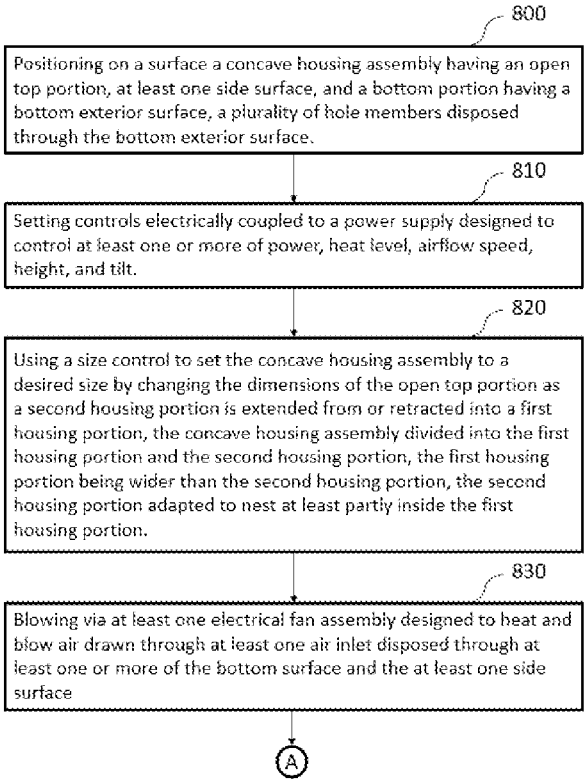
FIGS. 8A-8C illustrate a method of using the hands-free hair dryer assembly.
Figure 8B:
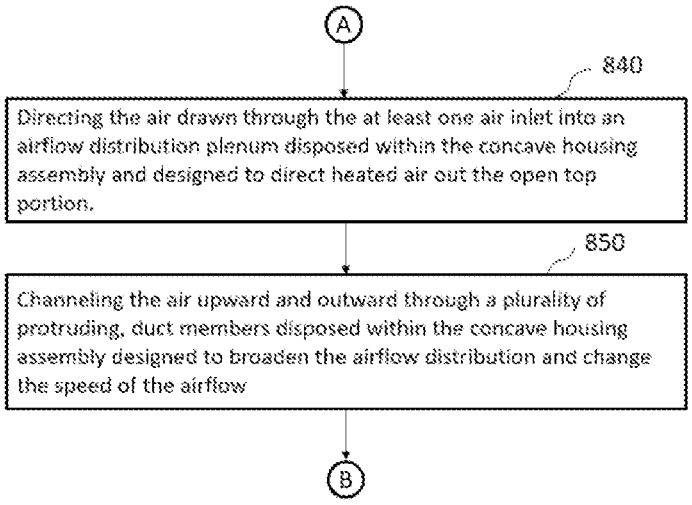
Figure 8C:
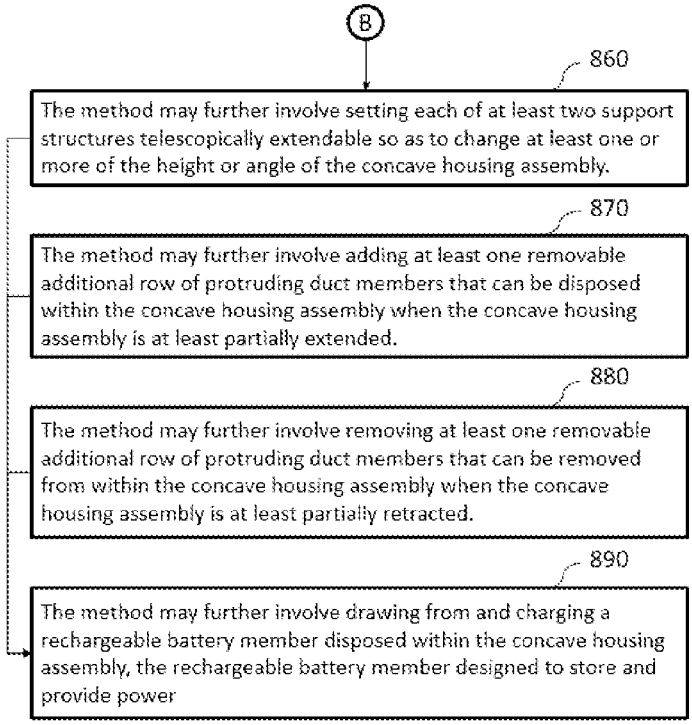

FIGS. 8A through 8C illustrate positioning on a surface a concave housing assembly having an open top portion, at least one side surface, and a bottom portion having a bottom exterior surface, a plurality of hole members disposed through the bottom exterior surface 800. Setting controls electrically coupled to a power supply designed to control at least one or more of power, heat level, airflow speed, height, and tilt 810. Using a size control to set the concave housing assembly to a desired size by changing the dimensions of the open top portion as a second housing portion is extended from or retracted into a first housing portion, the concave housing assembly divided into the first housing portion and the second housing portion, the first housing portion being wider than the second housing portion, the second housing portion designed to nest at least partly inside the first housing portion 820. Blowing via at least one electrical fan assembly designed to heat and blow air drawn through at least one air inlet disposed through at least one or more of the bottom surface and the at least one side surface 830. Directing the air drawn through the at least one air inlet into an airflow distribution plenum disposed within the concave housing assembly and designed to direct heated air out the open top portion 840. Channeling the air upward and outward through a plurality of protruding duct members disposed within the concave housing assembly designed to broaden the airflow distribution and change the speed of the airflow 850. The method may further involve setting each of at least two support structures telescopically extendable so as to change at least one or more of the height and angle of the concave housing assembly 860. The method may further involve adding at least one removable additional row of protruding duct members that can be disposed within the concave housing assembly when the concave housing assembly is at least partly extended 870. The method may further involve removing at least one removable additional row of protruding duct members that can be removed from within the concave housing assembly when the concave housing assembly is at least partly retracted 880. The method may further involve drawing from and charging a rechargeable battery member disposed within the concave housing assembly, the rechargeable battery member designed to store and provide power 890.

The following patents are incorporated by reference in their entireties: U.S. Pat. Nos. 3,974,840, 4,868,998, 5,036,601, and 5,488,783.

While the inventive concept has been described above in terms of specific embodiments, it is to be understood that the inventive concept is not limited to these disclosed embodiments. Upon reading the teachings of this disclosure many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. A hands-free hair dryer assembly comprising:

a concave housing assembly with an open top portion configured to be exposed to a user, at least one side surface, and a bottom portion having a bottom exterior surface, a plurality of hole members disposed through the bottom exterior surface;

the concave housing assembly divided into a first housing portion and a second housing portion, the first housing portion being wider than the second housing portion, the second housing portion adapted to nest at least partly inside the first housing portion and to change dimensions of the open top portion as the second housing portion is extended laterally from or retracted laterally into the first housing portion;

at least one air inlet disposed through at least one or more of the bottom surface and the at least one side surface;

at least one electrical fan assembly adapted to heat and blow air upward towards the user, air being drawn through the at least one air inlet;

an airflow distribution plenum disposed within the concave housing assembly and adapted to direct heated air formed into an airflow from the electrical fan assembly located within the distribution plenum out the open top portion;

a plurality of protruding duct members disposed within the concave housing assembly adapted to broaden airflow distribution and change a speed of the airflow; and a control assembly electrically coupled to a power supply adapted to allow the user to control at least one or more of a power level, a heat level, airflow speed, a concave housing assembly height, a tilt of the concave housing assembly, and lateral extension and retraction of the second housing member disposed at least partly laterally within the first housing member, wherein an open polymer rim member circumscribes an upper rim portion of the concave housing assembly adapted to further channel airflow emanating or flowing up from the protruding duct members and open top portion toward the user.

2. The hands-free hair dryer assembly in claim 1 wherein at least one support structure is adapted to at least partly separate the bottom surface from a support surface on which the hands-free hair dryer assembly is located.

3. The hands-free hair dryer assembly in claim 2 wherein there are at least two support structures that are telescopically extendable so as to change at least one or more of a height and an angle or tilt of the concave housing assembly.

4. The hands-free hair dryer assembly in claim 1 wherein at least one removable additional row of protruding duct members can be disposed within the concave housing assembly and on the distribution plenum when the concave housing assembly is at least partly laterally extended.

5. The hands-free hair dryer assembly in claim 1 wherein a rechargeable battery member is disposed within the concave housing assembly, the rechargeable battery member adapted to store and provide power to thereby enhance portability of the dryer assembly.

6. A hands-free hair dryer assembly comprising:

a substantially cuboid concave housing assembly with an open top portion, at least one side surface, and a bottom portion having a bottom exterior surface, a plurality of hole members disposed through the bottom exterior surface;

the concave housing assembly divided into a first housing portion and a second housing portion, the first housing portion being wider than the second housing portion, the second housing portion adapted to nest at least partly inside the first housing portion and to change dimensions of the open top portion as the second housing portion is extended from or retracted into the first housing portion;

at least one air inlet disposed through a right side surface and at least one air inlet disposed through a left side surface of the concave housing assembly;

at least one electrical fan assembly adapted to heat and blow air drawn through the at least one air inlet;

an airflow distribution plenum disposed within the concave housing assembly and adapted to direct heated air formed into an airflow through the open top portion;

a plurality of sixteen to twenty-four protruding duct members disposed within the concave housing assembly adapted to broaden airflow distribution and change a speed of the airflow;

at least two support structures telescopically extendable so as to change at least one or more of a height and an angle of the concave housing assembly; and a control assembly electrically coupled to a power supply adapted to allow the user to control a power level, a heat level, airflow speed, a height of the concave housing assembly, a tilt or angle of the concave housing assembly, and lateral extension-and retraction of the second housing member laterally disposed at least partly within the first housing member.

7. The hands-free hair dryer assembly in claim 6 wherein at least one removable additional row of protruding duct members can be disposed within the concave housing assembly when the concave housing assembly is at least partly extended.

8. The hands-free hair dryer assembly in claim 6 wherein an open polymer rim member circumscribes an upper rim portion of the concave housing assembly adapted to further channel airflow emanating up from the protruding duct members and the open top portion.

9. The hands-free hair dryer assembly in claim 6 wherein a rechargeable battery member is disposed within the concave housing assembly, the rechargeable battery member adapted to store and provide power.

* * * * *